United States Patent [19]

Finch

[11] Patent Number: 4,664,370

[45] Date of Patent: May 12, 1987

[54] EXERCISE DEVICE

[76] Inventor: Richard D. Finch, 1315 Kenwood Rd., Wilmington, Del. 19805

[21] Appl. No.: 789,513

[22] Filed: Oct. 21, 1985

[51] Int. Cl.[4] ..... A63B 5/00

[52] U.S. Cl. ..... 272/67; 272/143

[58] Field of Search ..... 272/67, 68, 116, 125, 272/126, 135, 140, 93, 62, 74, 75, 123, 143, 128, 900, 146, 97; 446/247

[56] References Cited

U.S. PATENT DOCUMENTS

| | | | |
|---|---|---|---|
| 618,990 | 2/1899 | Lubben | 272/900 |
| 3,588,102 | 6/1971 | Gifford | 272/67 X |
| 4,428,577 | 1/1984 | Weingardt | 272/135 |
| 4,466,610 | 8/1984 | Israel | 272/93 |
| 4,557,479 | 10/1985 | Guibert | 272/143 |

FOREIGN PATENT DOCUMENTS

| | | | |
|---|---|---|---|
| 0223926 | 6/1985 | Fed. Rep. of Germany | 272/122 |
| 3081 | of 1897 | United Kingdom | 272/62 |
| 160095 | 3/1921 | United Kingdom | 272/67 |

*Primary Examiner*—Richard J. Apley
*Assistant Examiner*—S. R. Crow
*Attorney, Agent, or Firm*—Mortenson & Uebler

[57] ABSTRACT

Exercise apparatus is provided comprising a bar-like rigid cross member having a length approximately the width of a person's shoulders, and two elongate tubular hand-gripping members affixed to the cross member in substantially parallel relationship, the tubular members being in substantially perpendicular relation to the cross member, each tubular member being affixed to the cross member so as to be freely rotatable about the longitudinal axis of the tubular member.

3 Claims, 5 Drawing Figures

EXERCISE DEVICE

BACKGROUND OF THE INVENTION

This invention relates generally to an exercise device especially suited for exercising a person's wrists, arms and upper body. It is especially suited for therapeutic use by persons who do not have full use of the wrists, arms and/or shoulders, such as persons recovering from broken bones or suffering from arthritis.

In ancient times, people naturally had to physically exercise simply to survive from day to day. Transportation was obtained by walking, food by hunting, and housing by physical human labor, all requiring a great deal of exercise.

Through the industrial revolution and into modern times, with modern day conveniences, strenuous physical exercise is not generally required for a large segment of the population. Many people in sedentary occupations develop their own exercise programs in order to reduce the risk of heart attacks, strokes and other diseases.

For such exercise programs various exercising devices have been developed for home use such as a pair of spring-loaded handles which the user squeezes, one for each hand. Also known is the device disclosed in U.S. Pat. No. 3,756,597 which utilizes a pair of rotating weight members attached to the ends of a connecting shaft. The shaft is gripped with the hands and the weight members are rotated rapidly to provide exertion for the use. A variation on such a device is disclosed in U.S. Pat. No. 4,513,963 which is believed to be the closest known prior art to the device according to the present invention.

SUMMARY OF THE INVENTION

Exercise apparatus is provided comprising a bar-like rigid cross member having a length approximately the width of a person's shoulders, and two elongate tubular hand-gripping members affixed to the cross member in substantially parallel relationship, the tubular members being in substantially perpendicular relation to the cross member, each tubular member being affixed to the cross member so as to be freely rotatable about the longitudinal axis of the tubular member. The hand-gripping tubular members can be affixed to the cross member by means of an elongate bolt positioned at the longitudinal axis within each tubular member and maintained there by a pair of ball bearing assemblies press fit into each tubular member, each bolt extending upwardly out of the tubular member through a sleeve, through an opening in the cross member, and affixed thereat by means of a wing nut. The cross member can have a plurality of spaced apart openings along its length to permit the tubular members to be affixed to the cross member at different distances of separation. The sleeve is preferably made of a plastic-like material which is compressible, thereby permitting some flex of each tubular member out of precise perpendicular relationship with the cross member.

DETAILED DESCRIPTION OF THE INVENTION AND PREFERRED EMBODIMENTS WITH REFERENCE TO THE DRAWINGS

Exercise apparatus is provided comprising a bar-like rigid cross member having a length approximately the width of a person's shoulders, and two elongate tubular hand-gripping members affixed to the cross member in substantially parallel relationship, the tubular members being in substantially perpendicular relation to the cross member, each tubular member being affixed to the cross member so as to be freely rotatable about the longitudinal axis of the tubular member.

Figures 1, 2, 3, 4:
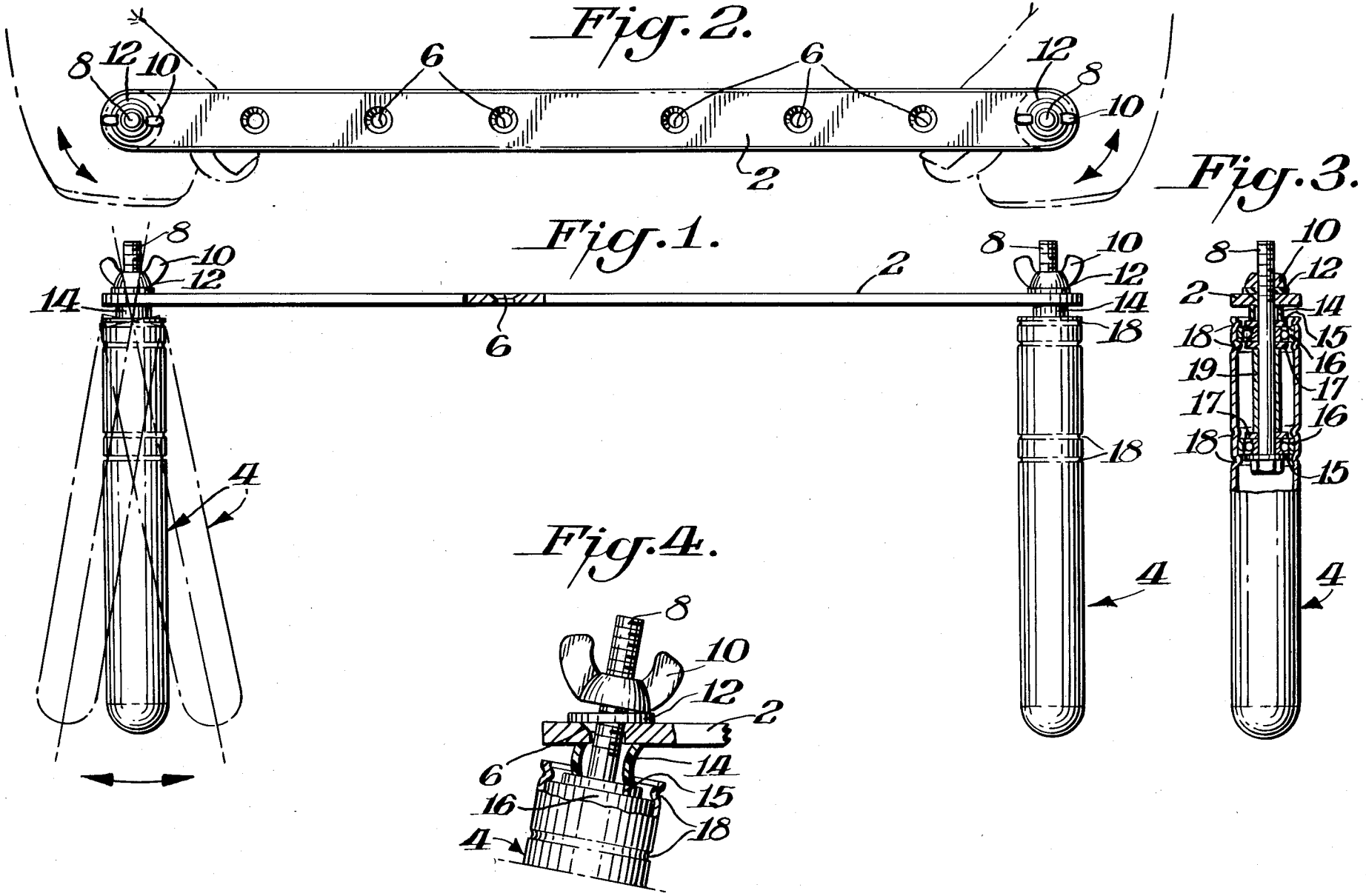
FIG. 1 is a front elevational view, partly broken away, of the exercise device of the invention.
FIG. 2 is a top plan view of the device.
FIG. 3 is an elevational view, partly in cross section, of one preferred tubular hand-gripping member of the device of the invention.
FIG. 4 is an exploded view, partly in cross section, of an upper portion of a preferred hand-gripping member which permits some flexure of this member from a perfectly perpendicular orientation with respect to the cross member.

A detailed description of the invention and preferred embodiments is best provided with reference to the drawings wherein FIG. 1 is a front elevational view of the exercise apparatus, partly broken away, showing bar-like cross member 2, preferably of aluminum or steel but many other rigid materials could be used, having affixed thereto at either end a tubular hand-gripping member 4, which also is preferably of steel but other rigid materials could also be used. Members 4 are affixed to bar 2 by bolt 8 and wing nut 10. Washer 12 is shown for completeness. When sleeve 14 is made of compressible plastic, some flexure in the width direction is available, and this is indicated by the phantom outlines of the left hand member 4 and the double arrow of FIG. 1. This flex availability is preferred. For an adult apparatus, a length of cross member 2 of about seventeen inches is preferred and a length of tubular hand grip of about eight and one-half inches is preferred, but these dimensions can be varied as desired. Spaced-apart openings such as opening 6, shown broken away, through which bolt 8 may be affixed, are provided to permit adjustment of the distance between the tubular members 4. For a child's device, the cross member 2 is preferably about twelve inches long and the tubular hand-gripping members 4 are about seven inches long. The indentations 18 in members 4 serve to press fit ball bearing assemblies within the tubes 4.

FIG. 2 shows a top plan view of the exercise apparatus being held by a person wherein the two double arrows indicate that each tubular hand-gripping member 4 is freely rotatable in each hand about the longitudinal axis of each tubular member. As indicated above, spaced-apart openings 6 provide means for adjusting the distance between the tubular members 4 which are affixed to bar 2 by means of bolt 8 and wing nut 10.

One tubular member 4 is shown in detail, in partial cross-section, in FIG. 3. Inside each tubular member 4, a bolt 8 is held at the center of tubular member 4 within bearing assemblies 16 which are press fit and held in place within the tube by indentations 18. Bolt 8 extends through washers 15, the bearing assemblies 16, washers 17, sleeve 19, and upwardly and outwardly from tubular member 4 through sleeve 14, bar member 2, washer 12, and grip member 4 is affixed to bar member 2 by wing nut 10 as shown.

In a preferred embodiment, sleeve 14 is of compressible plastic allowing hand member 4 to flex somewhat out of its precise perpendicular relationship with bar member 2, as shown in phantom in FIG. 1. FIG. 4 shows an exploded view of a hand member 4 and bar 2 in the flexed position. Therein plastic sleeve 14 is compressed and tubular member 4 is at an angle somewhat out of the precisely perpendicular orientation with respect to bar member 2. Plastic tubing such as Tygon® tubing, for example, is suitable for sleeve 14.

Figure 5:
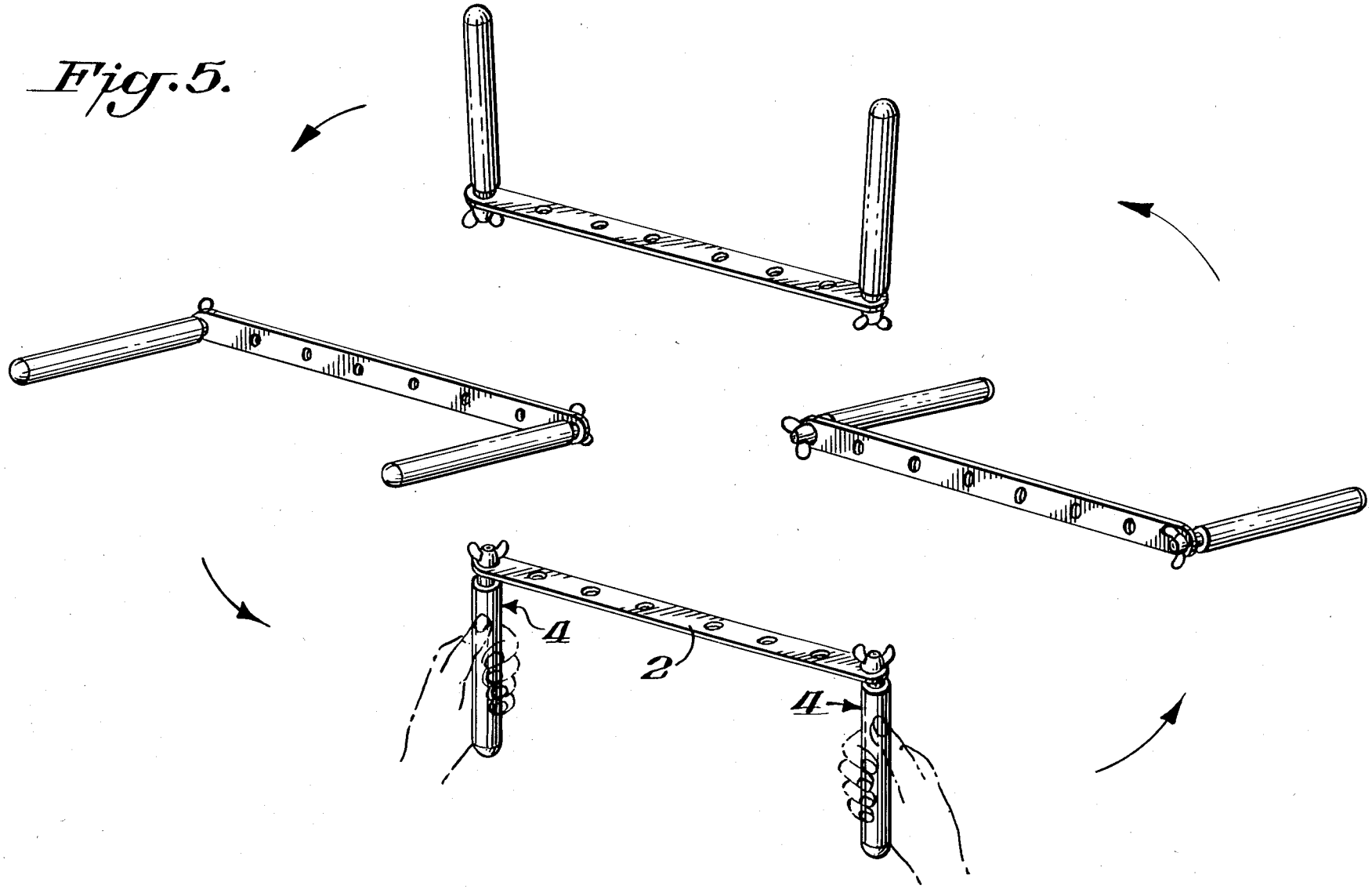
FIG. 5 is a schematic illustration of various positions of the apparatus of this invention in use.

FIG. 5 shows various pictorial views of positions of the exercise apparatus for the invention in use, indicating the complete inward-outward inversion capability of the device in the hands of the user.

One user who suffered severely from a broken wrist and who had only limited use of her wrist and arm prior to using this device, regained approximately 95% use of her wrist and arm after regular exercise with this device for about one month, after which she had virtually no pain associated with wrist and arm movement.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Exercise apparatus comprising:

a bar-like rigid cross member having a length approximately the width of a person's shoulders, and two elongate tubular hand-gripping members affixed to said cross member in substantially parallel relationship, said tubular members being in substantially perpendicular relation to said cross member.

means for affixing each said tubular member to said cross member so as to be freely and indefinitely continuously rotatable about the longitudinal axis of said tubular member, wherein said cross member has openings therethrough and wherein said hand-gripping tubular members are each affixed to said cross member by means of an elongate bolt positioned at the longitudinal axis within each tubular member, a pair of ball bearing assemblies press fit into each tubular member thereby maintaining the longitudinal position of said bolts, each said bolt extending upwardly out of said tubular member through a sleeve adjacent each said tubular member and through one of said openings in said cross member, and a wing nut affixing each bolt thereat.

2. The exercise apparatus of claim 1 wherein said cross member has a plurality of spaced apart openings along its length to permit the tubular members to be affixed to the cross member at different distances of separation.

3. The exercise apparatus of claim 1 wherein said sleeve is made of a plastic-like material which is compressible, thereby permitting some flex of each tubular member out of precise perpendicular relationship with said cross member.

* * * * *